US010899589B2

(12) United States Patent
Kitayama

(10) Patent No.: US 10,899,589 B2
(45) Date of Patent: Jan. 26, 2021

(54) CRANE VEHICLE

(71) Applicant: TADANO LTD., Kagawa (JP)

(72) Inventor: Hiroshi Kitayama, Kagawa (JP)

(73) Assignee: TADANO LTD., Kagawa (JP)

( * ) Notice: Subject to any disclaimer, the term of this patent is extended or adjusted under 35 U.S.C. 154(b) by 284 days.

(21) Appl. No.: 15/765,091

(22) PCT Filed: Sep. 29, 2016

(86) PCT No.: PCT/JP2016/078856
§ 371 (c)(1),
(2) Date: Mar. 30, 2018

(87) PCT Pub. No.: WO2017/057593
PCT Pub. Date: Apr. 6, 2017

(65) Prior Publication Data

US 2018/0273355 A1 Sep. 27, 2018

(30) Foreign Application Priority Data

Oct. 2, 2015 (JP) ..... 2015-196394

(51) Int. Cl.
*B66C 23/88* (2006.01)
*B66C 15/00* (2006.01)
(Continued)

(52) U.S. Cl.
CPC ..... *B66C 23/88* (2013.01); *B66C 13/18* (2013.01); *B66C 15/00* (2013.01); *B66C 15/06* (2013.01);
(Continued)

(58) Field of Classification Search
CPC ..... B66C 23/88; B66C 13/18; B66C 15/06; B66C 23/702; B66C 15/00; B66C 2700/0371
See application file for complete search history.

(56) References Cited

U.S. PATENT DOCUMENTS 6,994,223 B1 * 2/2006 Edgar, II ..... B66C 23/905 212/270
8,905,250 B2 12/2014 Stander
2011/0253662 A1 * 10/2011 Stander ..... B66C 13/14 212/281

FOREIGN PATENT DOCUMENTS

JP S59-162591 U 10/1984
JP H08-26673 A 1/1996
(Continued)

OTHER PUBLICATIONS

JP 2000001293 A, Kobe, Translation to English (Year: 2000).*
(Continued)

*Primary Examiner* — Abby Y Lin
*Assistant Examiner* — Renee LaRose
(74) *Attorney, Agent, or Firm* — Marshall, Gerstein & Borun LLP

(57) ABSTRACT

A device executes an actuation control process of causing the actuator to execute actuation corresponding to an operation signal in response to an output of the operation signal, a stopping process of stopping the actuation of the actuator in response to an output of a first over-winding signal or a second over-winding signal during the actuation control process, and a notification process of notifying whether or not the identification signal has already been output from an over-winding sensor in response to the first output of the operation signal corresponding to specific actuation of reducing a suspension length.

6 Claims, 6 Drawing Sheets

(51) Int. Cl.

| | |
|---|---|
| ***B66C 13/18*** | (2006.01) |
| ***B66C 15/06*** | (2006.01) |
| ***B66C 23/70*** | (2006.01) |

(52) U.S. Cl.
CPC .... *B66C 23/702* (2013.01); *B66C 2700/0371* (2013.01)

(56) References Cited

FOREIGN PATENT DOCUMENTS

| | | | | |
|---|---|---|---|---|
| JP | 2000-1293 | A | | 1/2000 |
| JP | 2000001293 | A | * | 1/2000 |
| JP | 2000-143152 | A | | 5/2000 |

OTHER PUBLICATIONS

International Search Report issued in PCT Patent Application No. PCT/JP2016/078856 dated Dec. 27, 2016.
International Preliminary Report on Patentability issued in PCT/JP2016/078856 dated Apr. 3, 2018.
Supplementary European Search Report issued in European Patent Application No. 16851764 dated May 27, 2019.

* cited by examiner

FIG. 4

| FIRST SPECIFIC ACTUATION | SECOND SPECIFIC ACTUATION |
|---|---|
| FALL-DOWN OF BOOM (JIB) | FALL-DOWN OF BOOM |
| EXTENSION OF BOOM (JIB) | EXTENSION OF BOOM |
| LIFTING OF FIRST HOOK | LIFTING OF SECOND HOOK |

(A)

| FLAG NAME | INITIAL VALUE | VALUE CHANGING CONDITION | INITIALIZATION CONDITION |
|---|---|---|---|
| INITIAL FLAG | OFF | EXECUTION OF STEP S13 | END OF ATTACHMENT/DETACHMENT OF ELECTRIC POWER TURNING-ON JIB |
| FIRST PRESENCE FLAG | OFF | OUTPUT OF FIRST IDENTIFICATION SIGNAL | |
| SECOND PRESENCE FLAG | OFF | OUTPUT OF SECOND IDENTIFICATION SIGNAL | |

(B)

CRANE VEHICLE

TECHNICAL FIELD

The present disclosure relates to a crane vehicle in which a jib is attachable and detachable to and from a front end of a boom.

BACKGROUND ART

For example, Japanese Patent Laid-open 2000-1293 discloses a crane vehicle that includes a telescopic boom having a front end to and from which a jib-boom is attachable and detachable and an over-winding preventive device that detects an over-winding state of a hook suspended from a front end of the telescopic boom or the jib-boom. In addition, in the crane vehicle having such a configuration described above, in general, a set of the hook and the over-winding preventive device is shared for the front end of the telescopic boom and the front end of the jib-boom.

Therefore, an operator who installs the jib-boom on the telescopic boom needs to detach the over-winding preventive device from the hook suspended from the front end of the telescopic boom, to install the jib-boom on the telescopic boom, to re-suspend, from the front end of the jib-boom, the hook suspended from the front end of the telescopic boom, and to attach the over-winding preventive device to the hook suspended from the front end of the jib-boom. In a case where the jib-boom is detached from the telescopic boom, such operations described above are performed in a reverse order.

SUMMARY OF THE DISCLOSURE

In a process of attaching and detaching the jib-boom to and from the telescopic boom, the over-winding preventive device is manually detached by the operator and is manually re-attached by the operator. Therefore, there is a possibility of occurrence of forgetting to attach the over-winding preventive device. When the crane vehicle is actuated without attaching the over-winding preventive device, there is a possibility that the hook will collide with the telescopic boom or the jib-boom and the collision will result in damage to the telescopic boom or the jib-boom, breaking of a rope for suspending the hook, or the like.

The present disclosure is made in consideration of such a circumstance described above, and an object thereof is to provide a crane vehicle of which the use is restricted in a state in which an over-winding sensor is not attached.

(1) According to the presently described embodiments, there is provided a crane vehicle including: a carrier; a boom that is supported by the carrier in a derrickable and telescopic manner; a jib that is attachable to and detachable from a front end of the boom; a first hook that is suspendible from both of the front end of the boom and a front end of the jib; a second hook that is suspendible from only the front end of the boom; an actuator that causes the boom to be telescopic, causes the boom to raise and lower, and winds and unwinds a rope by which each of the first hook and the second hook is suspended; a first over-winding sensor that is attachable to and detachable from both of the front end of the boom and the front end of the jib, outputs a first identification signal in response to installation to the front end, and outputs a first over-winding signal obtained in response to an event where a suspension length of the first hook is shorter than a threshold; a second over-winding sensor that is attachable to and detachable from only the front end of the boom, outputs a second identification signal in response to installation to the front end, and outputs a second over-winding signal obtained in response to an event where a suspension length of the second hook is shorter than a threshold; an operation unit that outputs an operation signal corresponding to an operation in response to reception of the operation of instructing actuation of the actuator; and a controller that controls the actuation of the actuator. In addition, the controller executes an actuation control process of causing the actuator to execute the actuation corresponding to the operation signal in response to the output of the operation signal, a stopping process of stopping the actuation of the actuator in response to the output of the first over-winding signal or the second over-winding signal during the actuation control process, and a notification process of notifying whether or not the first identification signal and the second identification signal have already been output, in response to the first output of the operation signal corresponding to specific actuation of reducing a suspension length.

According to this configuration, there is performed notification of whether or not the first over-winding sensor and the second over-winding sensor is installed, at a timing when an operation of instructing the specific actuation is performed. In this manner, it is possible to cause an operator to recognize forgetting of the installation of the first over-winding sensor at the time of attachment and detachment of the jib. In other words, actuation of the crane vehicle is restricted in a state in which the over-winding sensor is not attached.

(2) It is preferable that the controller execute the actuation control process in response to the output of the operation signal corresponding to first specific actuation of reducing the suspension length of the first hook after the first identification signal is output. It is preferable that the controller do not execute the actuation control process in response to the output of the operation signal corresponding to the first specific actuation before the first identification signal is output.

(3) For example, it is preferable that the jib installed on the front end of the boom be able to be telescopic and derricking. It is preferable that the actuator further cause the jib to be telescopic and the jib derricking. It is preferable that the first specific actuation mean any one of fall-down of the boom, extension of the boom, fall-down of the jib, extension of the jib, or lifting of the first hook.

According to this configuration, in a case where the first over-winding sensor is not attached, the execution of the first specific actuation is restricted. Similarly, in a case where the second over-winding sensor is not attached, the execution of the second specific actuation of reducing the suspension length of the second hook is restricted.

(4) For example, it is preferable that the crane vehicle further include a storage unit that stores a presence flag in which a first value, which indicates that the first identification signal is output, or a second value, which indicates that the first identification signal is not output, is set. In addition, it is preferable that the controller set the first value in the presence flag in response to the output of the first identification signal, set the second value in the presence flag in response to supply of power to the crane vehicle or attachment and detachment of the jib, and determine whether or not the first identification signal is output, based on a value set in the presence flag.

According to this configuration, an installed state of the first over-winding sensor is checked again at a timing when the power is supplied to the crane vehicle and at a timing when the jib is attached and detached. In this manner, the actuation of the crane vehicle is restricted in the state in which the over-winding sensor is not attached.

(5) It is preferable that the first over-winding sensor and the second over-winding sensor share a part of a signal line through which a signal is output to the controller.

For example, the signal line, through which the controller and the winding sensor are connected, is wound around a cord reel, is unwound in association with extension of the boom, and is wound in association with retraction of the boom. According to this configuration, since it is possible to decrease a diameter of the signal line extended along the boom, it is possible to reduce the cord reel in size.

(6) For example, it is preferable that the controller, the first over-winding sensor, and the second over-winding sensor be connected to each other via a controller area network.

According to the presently described embodiments, since installed states of the over-winding sensors are notified, at a timing when the operation of instructing the specific actuation is first performed, the actuation of the crane vehicle is restricted in the state in which the over-winding sensor is not attached.

BRIEF DESCRIPTION OF DRAWINGS

FIG. 4(A) illustrates a list of specific actuation, and FIG. 4(B) illustrates flags that are stored in a storage unit 51.

DETAILED DESCRIPTION

Hereinafter, preferred embodiments will be described with reference to appropriate figures. The embodiments are only aspects of the present invention, and it is needless to say that the embodiments may be modified in a range without departing from the gist of the present invention.

Figure 1:
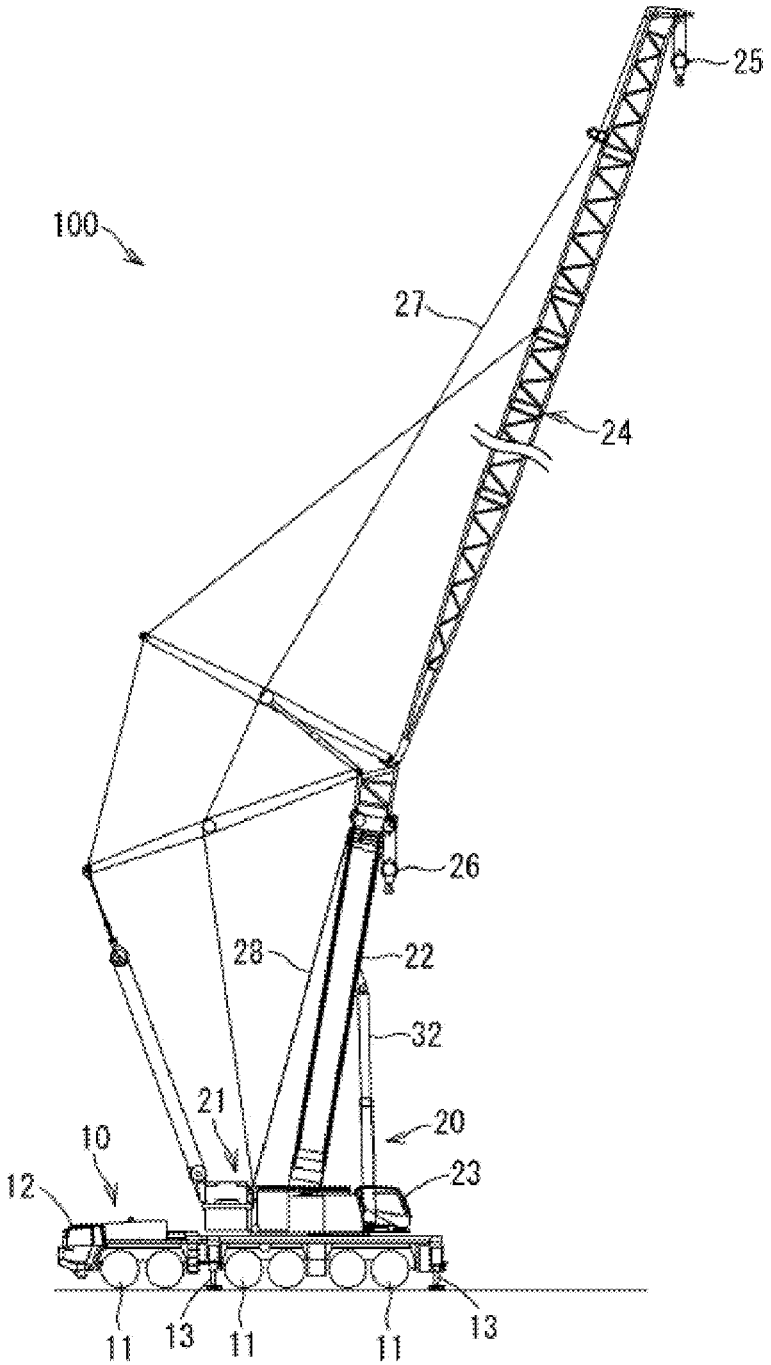
FIG. 1 is a schematic view illustrating an all-terrain crane 100 according to the embodiment.

[All-Terrain Crane 100] The all-terrain crane 100 according to the embodiment is described with reference to FIG. 1. As illustrated in FIG. 1, the all-terrain crane 100 according to the embodiment mainly includes a base vehicle (an example of a carrier) 10 and a crane apparatus 20. The all-terrain crane 100 is an example of the crane vehicle. However, a specific example of the crane vehicle is not limited to the all-terrain crane 100, and examples thereof may include a rough terrain crane, a cargo crane, or the like.

[Base Vehicle 10] As illustrated in FIG. 1, the base vehicle 10 mainly includes a plurality of tires 11, a carrier cabin 12, and outriggers 13. Rotation of the tires 11 by the power of an engine (not illustrated) causes the base vehicle 10 to travel. However, the base vehicle 10 may travel by caterpillars, instead of the tires 11.

The carrier cabin 12 includes an operation unit (For example, the steering, a shift lever, an accelerator pedal, a brake pedal, and the like) for controlling the travel of the base vehicle 10. An operator (that is, a driver) got in the carrier cabin 12 causes the base vehicle 10 to travel by operating the operation unit. The carrier cabin 12 according to the embodiment is not limited to an enclosed box-shaped cabin as illustrated in FIG. 1, and an open type cabin may be used.

The outrigger 13 causes the all-terrain crane 100 to have a stable posture when the crane apparatus 20 is actuated. The outriggers 13 according to the embodiment are provided on both of the right and left sides (illustrating only one side in FIG. 1), at two positions of the center and a rear portion of the base vehicle 10. The outrigger 13 is capable of performing a state change between an extension state in which the outriggers are in contact with the ground at positions at which the outriggers are extended out from the base vehicle 10 and an accommodating state in which the outriggers are accommodated in the base vehicle 10 in a state of being separated from the ground.

[Crane Apparatus 20] As illustrated in FIG. 1, the crane apparatus 20 mainly includes a swivel body 21, a boom 22, and a crane cabin 23. The crane apparatus 20 is actuated by the power of an engine (not illustrated) mounted on the swivel body 21, which is transmitted through a hydraulic system (not illustrated). In addition, a luffing jib (an example of a jib) 24, which will be described below, can be attached to and detached from a front end of the boom 22.

The swivel body 21 is supported by the base vehicle 10 in a swivelable manner. The swivel body 21 is swiveled by a swivel motor 31 (refer to FIG. 3). The boom 22 is supported by the swivel body 21 in an derrickable and telescopic manner. The boom 22 is caused to raise and lower by a derrick cylinder 32 (refer to FIGS. 1 and 3) and is caused to be telescopic by a telescopic cylinder 33 (refer to FIG. 3).

The crane cabin 23 includes an operation unit 46 (refer to FIG. 3) for controlling the actuation of the crane apparatus 20 and a display unit 36 that displays various items of information. For example, the operation unit 46 includes a swivel lever, a derrick lever, a telescopic-control lever, a first winch lever, a second winch lever, various types of buttons, and the like. The operator in the crane cabin 23 actuates the crane apparatus 20 by operating the operation unit 46. As illustrated in FIG. 1, the crane cabin 23 according to the embodiment is not limited to an enclosed box-shaped cabin as illustrated in FIG. 1, and an open type cabin may be used.

[Luffing Jib 24] The luffing jib 24 is configured to be attachable and detachable to and from the front end of the boom 22. The luffing jib 24 installed on the front end of the boom 22 is supported with respect to the boom 22 in a derrickable manner. In addition, the luffing jib 24 may be telescopic. The luffing jib 24 has a configuration in which a plurality of jibs are connected in a longitudinal direction. In other words, a length of the luffing jib 24 varies depending on a change in the number of jibs.

Figure 2:
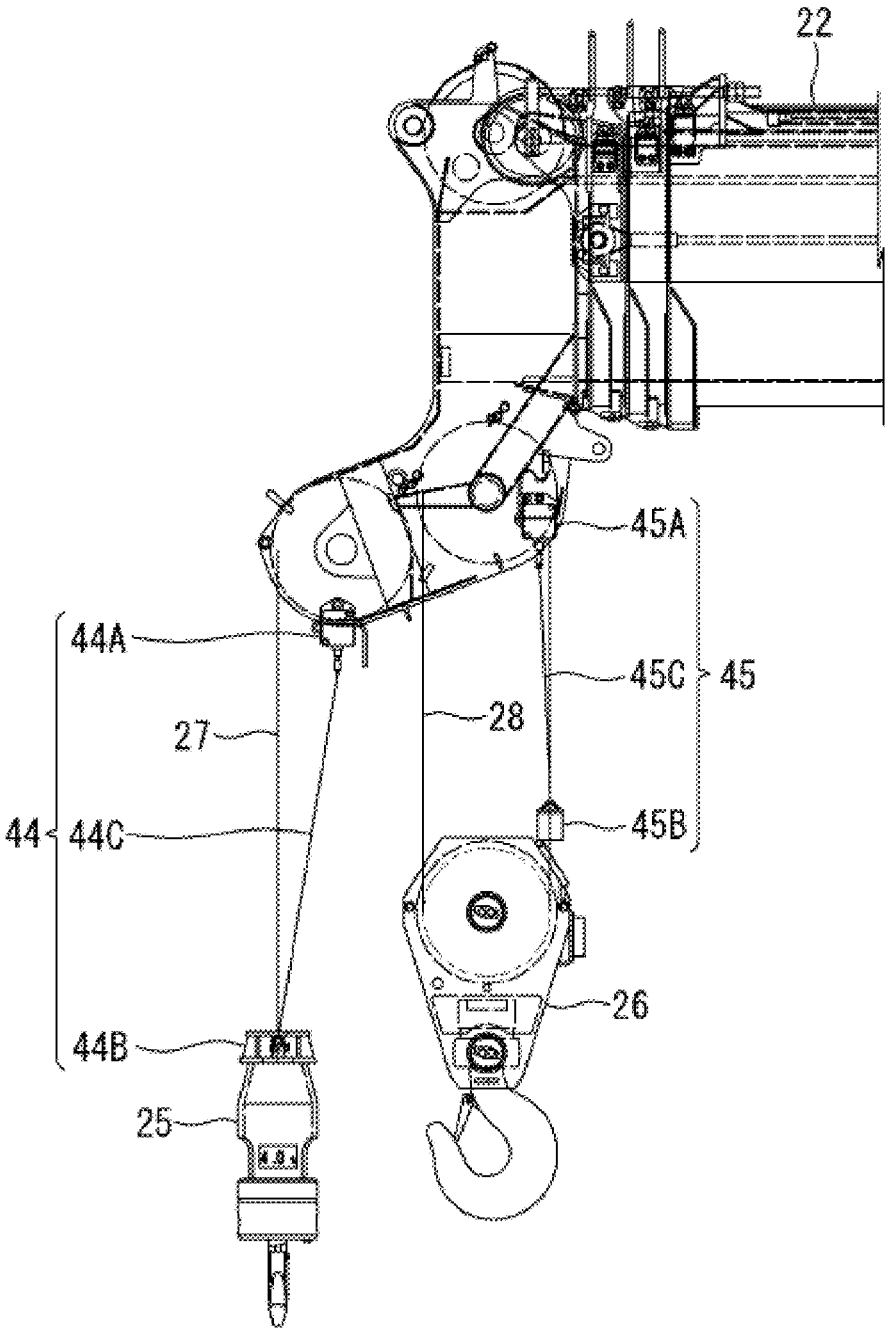
FIG. 2 is an enlarged view of a front end portion in a boom 22.

[First Hook 25 and Second Hook 26] The crane apparatus 20 includes a first hook 25 and a second hook 26. The first hook 25 is suspendible from the front end of the luffing jib 24 by a rope 27 as illustrated in FIG. 1 and is suspendible from the front end of the boom 22 by the rope 27 as illustrated in FIG. 2. On the other hand, as illustrated in FIGS. 1 and 2, the second hook 26 is suspendible from only the front end of the boom 22 by a rope 28. The first hook 25 is lifted and lowered by winding or unwinding of the rope 27 by a first winch 34 (refer to FIG. 3). The second hook 26 is lifted and lowered by winding or unwinding of the rope 28 by a second winch 35 (refer to FIG. 3).

Figure 3:
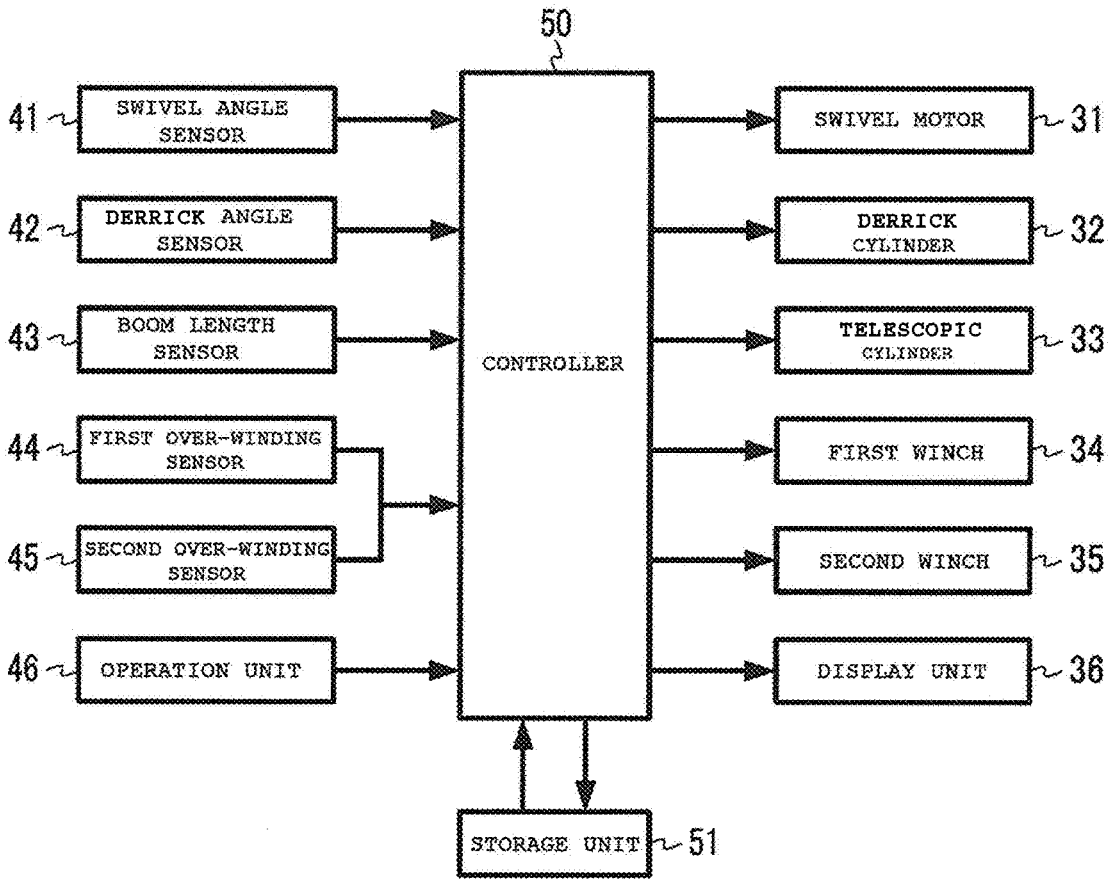
FIG. 3 is a functional block diagram of the all-terrain crane 100.

As illustrated in FIG. 3, the all-terrain crane 100 includes a controller 50. The controller 50 controls the actuation of the all-terrain crane 100. The controller 50 may be realized by a central processing unit (CPU) that executes a program stored in the storage unit 51, may be realized by a hardware circuit, or may be realized by a combination thereof. The storage unit 51 stores the program that is executed by the CPU, various items of information that are temporarily stored during the execution of the program, and various types of flags illustrated in FIG. 4(B).

The controller 50 acquires various types of signals that are output from a swivel angle sensor 41, a derrick angle sensor 42, a boom length sensor 43, a first over-winding sensor 44, a second over-winding sensor 45, and the operation unit 46. In addition, the controller 50 controls actuation of the swivel motor 31, the derrick cylinder 32, the telescopic cylinder 33, the first winch 34, and the second winch 35, based on the various types of acquired signals. Further, the controller 50 causes the display unit 36 to display the various items of information.

The swivel motor 31, the derrick cylinder 32, the telescopic cylinder 33, the first winch 34, and the second winch 35 according to the embodiment are hydraulic actuators. In other words, the controller 50 actuates the actuators by controlling a direction and a flow rate of hydraulic oil which is supplied. However, the actuators are not limited to the hydraulic actuators, and electric actuators or the like may be used.

Actuation illustrated in FIG. 4(A) of the types of actuation, which can be executed by the actuators, is an example of specific actuation of reducing suspension lengths of the hooks 25 and 26. Here, the "suspension length" represents a distance between the front end of the boom 22 (or the luffing jib 24) and the hook 25 or 26 suspended from the front end of the boom 22 (or the luffing jib 24). First specific actuation of reducing a suspension length of the first hook 25 includes fall-down of the boom 22, extension of the boom 22, and lifting of the first hook 25. In addition, second specific actuation of reducing a suspension length of the second hook 26 includes the fall-down of the boom 22, the extension of the boom 22, and lifting of the second hook 26.

The luffing jib 24 installed on the front end of the boom 22 may be configured to be capable of either being telescopic or derricking. In other words, the all-terrain crane 100 may include at least one of an actuator (for example, a cylinder) that causes the luffing jib 24 installed on the front end of the boom 22 to be telescopic and an actuator (for example, a winch) that performs the derricking of the luffing jib 24 installed on the front end of the boom 22. The first specific actuation includes the actuation of an actuator that extends the luffing jib 24 and the actuation of an actuator that performs the derricking of the luffing jib 24. Further, the all-terrain crane 100 may include a sensor that detects at least one of a length and a derrick angle of the luffing jib 24 and the operation unit 46 that receives at least one of a telescopic operation and a derrick operation of the luffing jib 24.

The swivel angle sensor 41 outputs a detection signal obtained in response to a swivel angle of the swivel body 21 (for example, an angle in a clockwise direction with a forward direction of the base vehicle 10 as 0°). The derrick angle sensor 42 outputs a detection signal obtained in response to a derrick angle of the boom 22 (an angle between a horizontal direction and the boom 22). The boom length sensor 43 outputs a detection signal obtained in response to a length of the boom 22. The first over-winding sensor 44 outputs a detection signal obtained in response to the suspension length of the first hook 25. The second over-winding sensor 45 outputs a detection signal obtained in response to the suspension length of the second hook 26. As illustrated in FIG. 2, the first over-winding sensor 44 is configured to have a switch 44A, a weight 44B, and a wire 44C. Similarly, the second over-winding sensor 45 is configured to have a switch 45A, a weight 45B, and a wire 45C.

The switches 44A and 45A are fixed to the front end of the boom 22. In addition, the switch 44A is fixed to the front end of the luffing jib 24 without illustration thereof. The weight 44B has a ring shape into which the rope 27 is inserted. The weight 45B has a ring shape into which the rope 28 is inserted. The wire 44C has one end that is installed on the switch 44A and the other end that is installed on the weight 44B. The wire 45C has one end that is installed on the switch 45A and the other end that is installed on the weight 45B.

The switches 44A and 45A are connected to the controller 50 through a signal line (not illustrated). The controller 50 and the switches 44A and 45A in the embodiment are connected to each other via a bus type controller area network (CAN). In other words, the controller 50 and the switches 44A and 45A transmit and receive a CAN frame through the signal line. Examples of the "signal line" in the present specification include two activation signal lines, through which the activation signals are transmitted, and power lines through which power is supplied from the controller 50 to the switches 44A and 45A.

In addition, the switches 44A and 45A share a part of a signal line (that is, the activation signal line) through which the signal is output to the controller 50. For example, the signal lines, through which the controller 50 and the winding sensors 44 and 45 are connected, are wound around cord reels provided on a base end side of the boom 22. The signal line wound around the cord reel is unwound in association with extension of the boom 22 and is wound in association with retraction of the boom 22. One signal line is extended from the controller 50 to the front end of the boom 22, and the signal line diverges from the front end of the boom 22 to each of the switches 44A and 45A.

When the suspension length of the first hook 25 is longer than a length of the wire 44C, the first hook 25 and the weight 44B are separated from each other. In this manner, some circuits in the switch 44A shut off by the wire 44C tensioned to the weight 44B. On the other hand, when the suspension length of the first hook 25 is shorter than the length of the wire 44C, the weight 44B is supported by the first hook 25, and thereby the wire 44C is bent. In this manner, the circuits in the switch 44A are connected. The length of the wire 44C is an example of a threshold.

The switch 44A outputs a signal obtained in response to a connection state of the circuits to the controller 50. Specifically, the switch 44A outputs a first over-winding signal indicating that the suspension length of the first hook 25 is shorter than the threshold, in response to the connection of the circuits. In addition, the switch 44A outputs a first identification signal including first identification information for identifying the first over-winding sensor 44. For example, the first identification information is repeatedly output at predetermined time intervals, in response to the installation of the first over-winding sensor 44 on the boom 22 or the luffing jib 24 (more specifically, supply of the power to the switch 44A through the signal line). The first identification information may also be included in the first over-winding signal.

The actuation of the second over-winding sensor 45 is common to that of the first over-winding sensor 44. However, a signal output from the second over-winding sensor 45 includes second identification information for identifying the second over-winding sensor 45, instead of the first identification information. In other words, the second over-winding sensor 45 outputs a second over-winding signal obtained in response to an event where the suspension length of the second hook 26 is shorter than the threshold. In addition, the second over-winding sensor 45 repeatedly transmits the second identification signal at predetermined time intervals, in response to the installation to the boom 22. In addition, the thresholds of the over-winding sensors 45 and 46 (that is, lengths of the wires 44C and 45C) may be the same or different from each other.

The operation unit 46 receives an operation for actuating the crane apparatus 20. The operation unit 46 outputs an operation signal in response to the received operation. In other words, the controller 50 actuates the crane apparatus 20 based on the operation received through the operation unit 46. The operation unit 46 is capable of receiving one operation (hereinafter, described as a "single operation") or is capable of simultaneously receiving a plurality of operations (hereinafter, described as a "multiple operations"). Hereinafter, an operation of instructing execution of the first specific actuation is described as a "first specific operation", an operation of instructing execution of the second specific actuation is described as a "second specific operation", and the first specific operation and the second specific operation are collectively described as the "specific operation".

Figure 6:
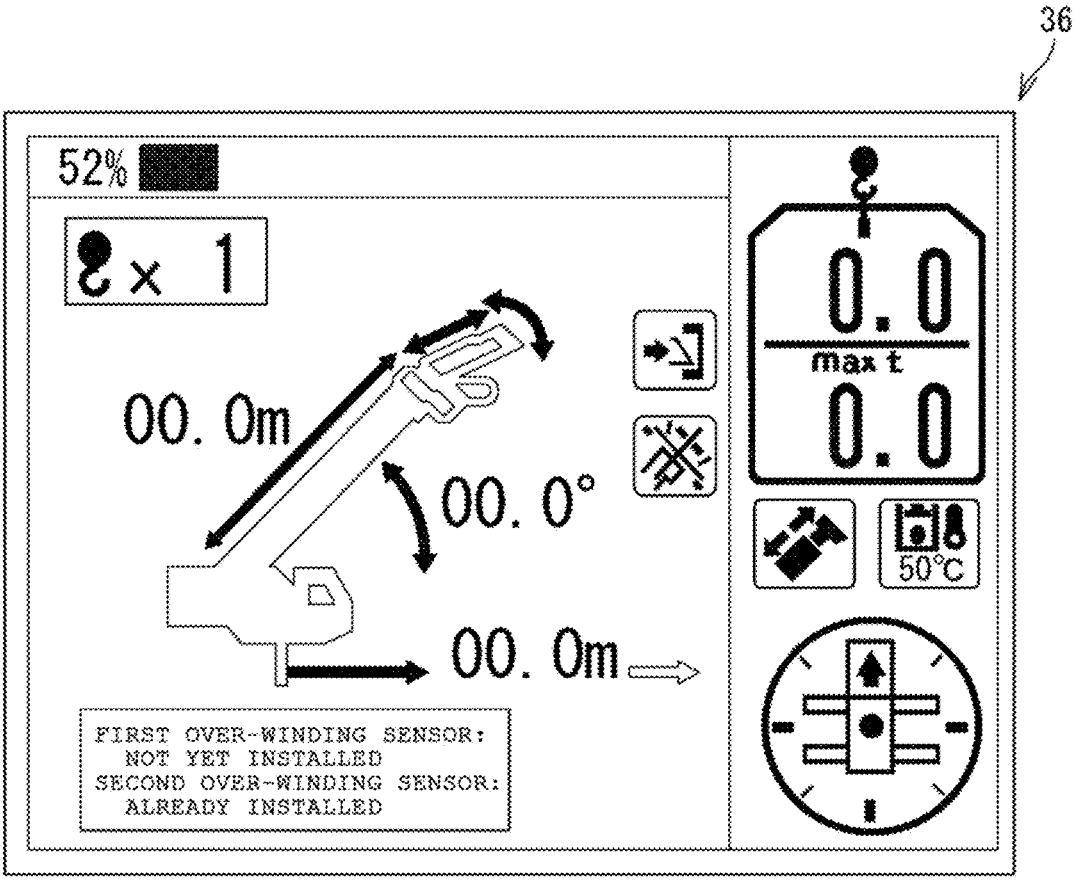
FIG. 6 illustrates an example of a display unit 36.

For example, as illustrated in FIG. 6, the display unit 36 displays the swivel angle of the swivel body 21, the length of the boom 22, the derrick angle of the boom 22, an operation radius of the boom 22, a suspended weight obtained by the suspension from the hooks 25 and 26, and the like. In addition, the display unit 36 displays various types of messages in Steps S13, S20, and the like which will be described below. For example, a part of the display unit 36 and the operation unit 46 may serve as a display and an operation panel of an overload preventive device.

An initial flag illustrated in FIG. 4(B) shows whether or not the specific actuation is executed from a timing when the electric power of the all-terrain crane 100 is turned on (that is, from a timing when the engine starts actuating) or from a timing when the luffing jib 24 is attached and detached to the present. The initial value of the initial flag is set to "OFF" which indicates that the specific actuation is not executed. In addition, "ON", which indicates that the specific actuation is executed, is set to the initial flag in response to execution of Step S13 which will be described below.

A first presence flag illustrated in FIG. 4(B) shows whether or not the first identification signal is output from the first over-winding sensor 44 from the timing when the electric power of the all-terrain crane 100 is turned on or from the timing when the luffing jib 24 is attached and detached to the present. In other words, the first presence flag shows whether or not the first over-winding sensor 44 is installed. The initial value of the first presence flag is set to "OFF (an example of a second value" which indicates that the first over-winding sensor 44 is not installed. In addition, "ON (an example of a first value)", which indicates that the first over-winding sensor 44 is installed, is set to the first presence flag in response to an output of the first identification signal.

A second presence flag illustrated in FIG. 4(B) shows whether or not the second identification signal is output from the second over-winding sensor 45 from the timing when the electric power of the all-terrain crane 100 is turned on or from the timing when the luffing jib 24 is attached and detached to the present. In other words, the second presence flag shows whether or not the second over-winding sensor 45 is installed. The initial value of the second presence flag is set to "OFF" which indicates that the second over-winding sensor 45 is not installed. In addition, "ON", which indicates that the second over-winding sensor 45 is installed, is set to the second presence flag in response to an output of the second identification signal.

Further, the initial value of "OFF" is set to the initial flag, the first presence flag, and the second presence flag in response to an event where the electric power of the all-terrain crane 100 is turned on or an event where the luffing jib 24 is attached and detached. A change in setting values of the initial flag, the first presence flag, and the second presence flag is performed by the controller 50.

[Attachment/Detachment Operation of Luffing Jib 24] Next, a procedure of installation of the luffing jib 24 on the front end of the boom 22 will be described. A detachment procedure of the luffing jib 24 from the front end of the boom 22 is reverse to the following procedure.

The all-terrain crane 100 is capable of transitioning a state to a first actuation state in which the crane apparatus 20 is actuated in a state in which the luffing jib 24 is detached, a second actuation state in which the crane apparatus 20 is actuated in a state in which the luffing jib 24 is attached, and a preparation state in which the luffing jib 24 is attached and detached to and from the boom 22. The maximum weight of the suspension which can be suspended from the hooks 25 and 26 is different in the first actuation state and the second actuation state. Specifically, the maximum weight in the first actuation state is larger than the maximum weight in the second actuation state. In addition, the preparation state means a state in which only the minimum actuation that is necessary for the attachment and detachment of the luffing jib 24 is allowed and other actuations are restricted. The state of the all-terrain crane 100 is switched by an operator through the operation unit 46.

In addition, the operator switches the state of the all-terrain crane 100 from the first actuation state to the preparation state through the operation unit 46. Next, the operator detaches the weight 44B and the wire 44C from the front end of the boom 22, installs the luffing jib 24 on the front end of the boom 22, and suspends the first hook 25 from the front end of the luffing jib 24 by the rope 27. Next, the operator installs the weight 44B and the wire 44C on the front end of the luffing jib 24 and connects the switch 44A on the front end of the luffing jib 24 and the controller 50 by the signal line. In this manner, the first identification signal is output at predetermined time intervals from the switch 44A.

Further, the operator switches the state of the all-terrain crane 100 from the preparation state to the second actuation state through the operation unit 46. The controller 50 initializes the initial flag, the first presence flag, and the second presence flag in response to the switch of the state of the all-terrain crane 100 to the second actuation state. Further, the controller 50 sets "ON" to the first presence flag in response to an output of the first identification signal after the first presence flag is initialized. In addition, the controller 50 sets "ON" to the second presence flag in response to an output of the second identification signal after the second presence flag is initialized.

Figure 5:
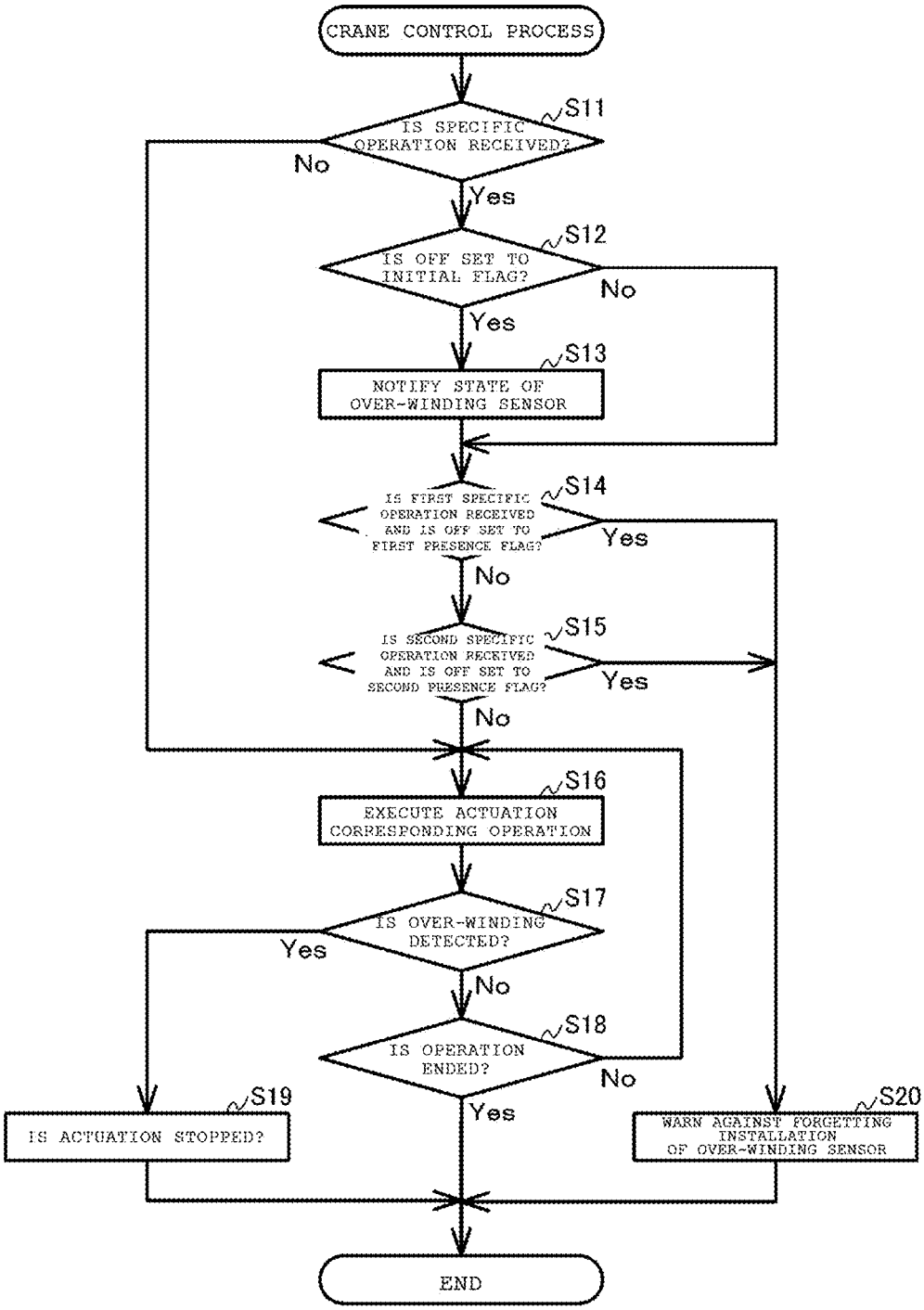
FIG. 5 is a flowchart of a crane control process.

[Crane Control Process] Next, a process of the controller 50 that controls the actuation of the crane apparatus 20 will be described with reference to FIG. 5. For example, the controller 50 executes a crane control process illustrated in FIG. 5 in response to reception of the operation of actuating the crane apparatus 20 through the operation unit 46 (that is, an output of an operation signal from the operation unit 46).

First, the controller 50 determines whether or not the specific operation is received through the operation unit 46 (S11). In a case where the multiple operations are received, the controller 50 determines whether one of the multiple operations is the specific operation (Yes in S11) or all of the multiple operations are not the specific operation (No in S11). Next, the controller 50 checks a setting value of the initial flag (S12) in response to the determination that the specific operation is received (Yes in S11).

The controller 50 notifies whether or not the first over-winding sensor 44 and the second over-winding sensor 45 are installed (S13), in response to an event where "OFF" is set to the initial flag (Yes in S12). In other words, the controller 50 notifies whether or not the first identification signal and the second identification signal are output after the first presence flag and the second presence flag are most recently initialized. On the other hand, the controller 50 skips the process of Step S13 in response to the event where "ON" is set to the initial flag (No in S12). The process of Step S13 is an example of a notification process.

For example, as illustrated in FIG. 6, the controller 50 may cause the display unit 36 to display a message showing that the first over-winding sensor 44 is "not yet installed" and the second over-winding sensor 45 has been "already installed". Content that is notified in Step S13 changes depending on the setting values of the first presence flag and the second presence flag. In other words, "not yet installed" is displayed in a case where "OFF" is set to the corresponding presence flag, and "already installed" is displayed in a case where "ON" is set to the corresponding presence flag. FIG. 6 illustrates a display example in a case where "OFF" is set to the first presence flag, and "ON" is set to the second presence flag.

Next, the controller 50 determines whether or not "OFF" is set to the first presence flag in a case where the first specific operation is received through the operation unit 46 (S14). In other words, the controller 50 determines whether or not the first over-winding sensor 44 is installed in a case where an operation of reducing the suspension length of the first hook 25 is received. In addition, the controller 50 determines whether or not "OFF" is set to the second presence flag in a case where the second specific operation is received through the operation unit 46 (S15). In other words, the controller 50 determines whether or not the second over-winding sensor 45 is installed in a case where an operation of reducing the suspension length of the second hook 26 is received.

The controller 50 causes the actuator to execute actuation corresponding to an operation received through the operation unit 46 (S16), in response to an event where the operation does not match both conditions of Steps S14 and S15 (No in S14 and No in S15). The process of Step S16 is an example of an actuation control process. For example, in a case where an operation of instructing the lifting of the second hook 26 (that is, an operation of the second winch lever) is received, the controller 50 causes the second winch 35 to wind the rope 28. Since the suspension length of the first hook 25 is not reduced in the operation, the winding of the rope 28 by the second winch 35 may be executed even when "OFF" is set to the first presence flag.

Next, the controller 50 continues performing the process of Step S16 until the winding signal is output from the winding sensors 44 and 45 (Yes in S17) or the output of the operation signal from the operation unit 46 is stopped (Yes in S18). In other words, in the example described above, the second winch 35 continues winding the rope 28 until the suspension length of the second hook 26 is shorter than the threshold or the second winch lever returns to a neutral position.

The controller 50 performs an emergency stop of the actuator actuated in Step S16 (S19) and ends the crane control process, in response to the output of the winding signal (Yes in S17). In other words, the controller 50 stops supplying the hydraulic oil to the actuator. In the case where multiple operations are received, the controller 50 may stop only an actuator that executes the specific actuation or may stop all of the actuators. This can be controlled by blocking of circulation of the hydraulic oil at any position of flow paths from a hydraulic tank to the actuators. The process of Step S19 is an example of a stopping process.

On the other hand, the controller 50 performs a normal stop of the actuator actuated in Step S16 and ends the crane control process, in response to the output of the operation signal from the operation unit 46 (Yes in S18). For example, the normal stop is different from the emergency stop described above in that stopping speeds of all of the types of actuation are controlled such that there is a small variation in load obtained by the suspension from the hooks 25 and 26.

In addition, the controller 50 warns against forgetting the installation of the over-winding sensor (S20), in response to an event where the first specific operation is received and "OFF" is set to the first presence flag (Yes in S14) or in response to an event where the second specific operation is received and "OFF" is set to the second presence flag (Yes in S15). The controller 50 ends the crane control process without executing the process of Step S16. For example, in Step S20, the controller 50 may cause the display unit 36 to display a message that "since the over-winding sensor is not installed, the specific actuation cannot be executed".

Further, the controller 50 skips the processes of Step S12 to S15 and executes the processes of Steps S16 to S18, in response to determination that an operation different from the specific operation is received (No in S11). In this case, since actuation that is not the specific actuation is executed in Step S16, the over-winding signal is not output from the over-winding sensors 44 and 45. In other words, the controller 50 causes an actuator to execute corresponding actuation (S16) until the output of the operation signal from the operation unit 46 is stopped (No in S18).

[Operational Effects of Embodiment] According to the embodiment described above, there is notified whether or not the first over-winding sensor 44 and the second over-winding sensor 45 are installed, at a timing when the specific operation is first received after the electric power of the all-terrain crane 100 is turned on or after the luffing jib 24 is attached and detached. In this manner, the operator can recognize forgetting of the installation of the first over-winding sensor 44 at the time of attachment and detachment of a luffing jib 24. In other words, actuation of the all-terrain crane vehicle 100 is restricted in the state in which the over-winding sensor 44 or 45 is not attached.

In addition, according to the configuration described above, in a case where the first over-winding sensor 44 is not attached, the execution of the first specific actuation is restricted. In other words, the execution of the first specific actuation is restricted before the first identification signal is output, and it is possible to execute the first specific actuation after the first identification signal is output. Similarly, in a case where the second over-winding sensor 45 is not attached, the execution of the second specific actuation is restricted. In this manner, it is possible to reliably prevent the all-terrain crane 100 from being actuated in the state in which the winding sensor 44 or 45 is not attached.

Further, the over-winding sensors 44 and 45 share a part of the signal line, and thereby it is possible to decrease a diameter of the signal line extended along the boom 22. As a result, it is possible to reduce a size of the cord reel around which the signal line is wound. However, a so-called star network in which the controller 50 and each of the over-winding sensors 44 and 45 are connected by individual signal lines may be employed.

In the embodiment described above, an example in which the process of Step S13 is executed only in the case where "OFF" is set to the initial flag, is described. However, the determination of Step S12 may be omitted and the process of Step S13 may be executed whenever the specific operation is received. A method of notification in Step S13 is not limited to displaying the message on the display unit 36, and a method of outputting notification sound from a speaker (not illustrated) or a method of lighting an LED (not illustrated) may be used. A method of warning in Step S20 is also the same as that.

In addition, in the embodiment described above, an example in which the determinations of Steps S14 and S15 are executed. However, since the second over-winding sensor 45 is normally attached and detached, it is possible to omit the process of Step S15. In addition, in a case where "OFF" is set to at least one of the first presence flag and the second presence flag regardless of a combination of the specific operation and the setting value of the presence flag, the crane control process may be ended without executing the process of Step S16.

Further, in the embodiment described above, an example in which the over-winding sensors 44 and 45 repeatedly output the identification signals at the predetermined time intervals is described; however, the output timing of the identification signal is not limited thereto. For example, the over-winding sensors 44 and 45 may output the identification signals for identifying the sensors, in response to an event where an output instructing signal for instructing an output of the identification signal is received from the controller 50.

The invention claimed is:

1. A crane vehicle comprising:

a carrier;

a boom that is supported by the carrier in an undulating and telescopic manner;

a jib that is attachable and detachable to and from a front end of the boom;

a first hook that is suspendible from both of the front end of the boom and a front end of the jib;

a second hook that is suspendible from only the front end of the boom;

an actuator that causes the boom to be telescopic, causes the boom to undulate, and winds and unwinds a rope by which each of the first hook and the second hook is suspended;

a first over-winding sensor that is attachable and detachable to and from both of the front end of the boom and the front end of the jib, wherein the first over-winding sensor is configured to output a first identification signal in response to installation of the first over-winding sensor to the front end of the boom or the front end of the jib, and wherein the first over-winding sensor is further configured to output a first over-winding signal obtained in response to an event where a suspension length of the first hook is shorter than a first threshold;

a second over-winding sensor that is attachable and detachable to and from only the front end of the boom, wherein the second over-winding sensor is configured to output a second identification signal in response to installation to the front end of the boom, and wherein the second over-winding sensor is further configured to output a second over-winding signal obtained in response to an event where a suspension length of the second hook is shorter than a second threshold;

an operation unit that outputs an operation signal corresponding to an operation in response to reception of the operation of instructing actuation of the actuator; and a controller that controls the actuation of the actuator, wherein the controller executes an actuation control process of causing the actuator to execute the actuation corresponding to the operation signal in response to the output of the operation signal, a stopping process of stopping the actuation of the actuator in response to the output of the first over-winding signal or the second over-winding signal during the actuation control process, and a notification process of, in response to the output of the operation signal corresponding to a specific actuation of reducing either the suspension length of the first hook or the suspension length of the second hook, notifying whether or not the first identification signal and the second identification signal were already output prior to the output of the operation signal corresponding to the specific actuation.

2. The crane vehicle according to claim 1, wherein the specific actuation is a first specific actuation of reducing the suspension length of the first hook, wherein the controller is configured to execute the actuation control process in response to the output of the operation signal when the output of the operation signal occurs after the first identification signal is output, and wherein the controller is configured to not execute the actuation control process in response to the output of the operation signal when the output of the operation signal occurs before the first identification signal is output.

3. The crane vehicle according to claim 2, wherein the jib installed on the front end of the boom is able to be telescopic and derricking, wherein the actuator further causes the jib to be telescopic and the jib derricking, and wherein the first specific actuation means any one of fall-down of the boom, extension of the boom, fall-down of the jib, extension of the jib, or lifting of the first hook.

4. The crane vehicle according to claim 1, comprising:

a storage unit that stores a presence flag in which a first value, which indicates that the first identification signal has been output, or a second value, which indicates that the first identification signal has not been output, is set, and wherein the controller is configured to set the first value in the presence flag in response to the output of the first identification signal, is configured to set the second value in the presence flag in response to supply of power to the crane vehicle or attachment and detachment of the jib, and is configured to determine whether or not the first identification signal has been output, based on a value set in the presence flag.

5. The crane vehicle according to claim 1, wherein the first over-winding sensor and the second over-winding sensor share a part of a signal line through which a signal is output to the controller.

6. The crane vehicle according to claim 1, wherein the controller, the first over-winding sensor, and the second over-winding sensor are connected to each other via a controller area network.

* * * * *